US006830044B2

(12) United States Patent
Hansen et al.

(10) Patent No.: US 6,830,044 B2
(45) Date of Patent: Dec. 14, 2004

(54) PNEUMATIC BALL PROJECTING APPARATUS

(76) Inventors: Howard E. Hansen, 678 Gary St., Ripon, WI (US) 54971; William Lewis Holke, 28500 W. Heritage Oak Rd., Barrington, IL (US) 60010

( * ) Notice: Subject to any disclaimer, the term of this patent is extended or adjusted under 35 U.S.C. 154(b) by 0 days.

(21) Appl. No.: 10/348,698

(22) Filed: Jan. 21, 2003

(65) Prior Publication Data

US 2004/0139955 A1 Jul. 22, 2004

(51) Int. Cl.[7] ..... F41B 11/00
(52) U.S. Cl. ..... 124/56
(58) Field of Search ..... 124/56, 69, 70, 124/71, 72, 73

(56) References Cited

U.S. PATENT DOCUMENTS 3,009,703 A * 11/1961 Jentsch et al. ..... 273/356
3,905,349 A * 9/1975 Nielsen et al. ..... 124/73
3,930,486 A * 1/1976 Kahelin ..... 124/72
4,021,037 A * 5/1977 Torbet ..... 473/431
4,027,646 A * 6/1977 Sweeton ..... 124/56
4,207,857 A * 6/1980 Balka, Jr. ..... 124/56
4,241,717 A * 12/1980 Mariani ..... 124/83
4,291,665 A * 9/1981 Bash et al. ..... 124/56
4,372,283 A * 2/1983 Balka, Jr. ..... 124/56
5,097,985 A * 3/1992 Jones ..... 221/86
2003/0101978 A1 * 6/2003 Smith et al. ..... 124/69

* cited by examiner

*Primary Examiner*—Teri P. Luu
*Assistant Examiner*—Jordan Lofdahl
(74) *Attorney, Agent, or Firm*—Merchant & Gould, P.C.

(57) ABSTRACT

An apparatus that propels a ball pneumatically is provided with an adapter for imparting spin to the ball. In a further aspect, the apparatus can be provided with a position adjuster that cooperates with a ball exit tube of the apparatus. A further aspect is directed to a platform that allows the apparatus to be supported on a ladder-like device. A pneumatic projectile propulsion apparatus is capable of achieving high speed with a simple and practical structure.

20 Claims, 3 Drawing Sheets

PNEUMATIC BALL PROJECTING APPARATUS

BACKGROUND OF THE INVENTION

The present invention is directed to an apparatus for pneumatic propulsion of a ball or similar object. Further, the present invention provides an apparatus that is capable of propelling a ball or similar object pneumatically with high accuracy at speeds useful for baseball and softball batting training and the like.

Devices that propel a ball by means of a mechanical arm or rotating disks generally have been used for baseball and softball training. These devices have not been satisfactory in providing high-speed propulsion with sufficient accuracy. Devices that use pneumatic propulsion for tennis training also have been known. These also have not been satisfactory in providing high-speed propulsion and accuracy for training.

SUMMARY OF THE INVENTION

The present invention provides an apparatus capable of projecting a ball or similar object pneumatically with sufficient accuracy, e.g. for baseball, softball and other training purposes. The present invention further provides an apparatus that is capable of projecting a ball at a velocity of at least 90 mph (145 kph), preferably at least 100 mph (160 kph) and more preferably at least 110 mph (175 kph) using a single blower motor requiring no more than 15 amps of power. The present invention further provides an apparatus that is capable of projecting a ball at a velocity of at least 140 mph (225 kph) using plural blowers. The present invention further provides training methods that make use of one or more of the various aspects of apparatus that are discussed above.

The invention is described in more detail below. The present invention is not limited to the specific embodiments described below. Modifications will be apparent and are intended to be encompassed by the present invention.

DETAILED DESCRIPTION

The present invention will be described below with reference to the accompanying drawings. The present invention is not limited to the specific aspects of the invention discussed below. The present application incorporates by reference the disclosure of U.S. Ser. No. 10/091,126 filed Mar. 4, 2002.

Figure 1:
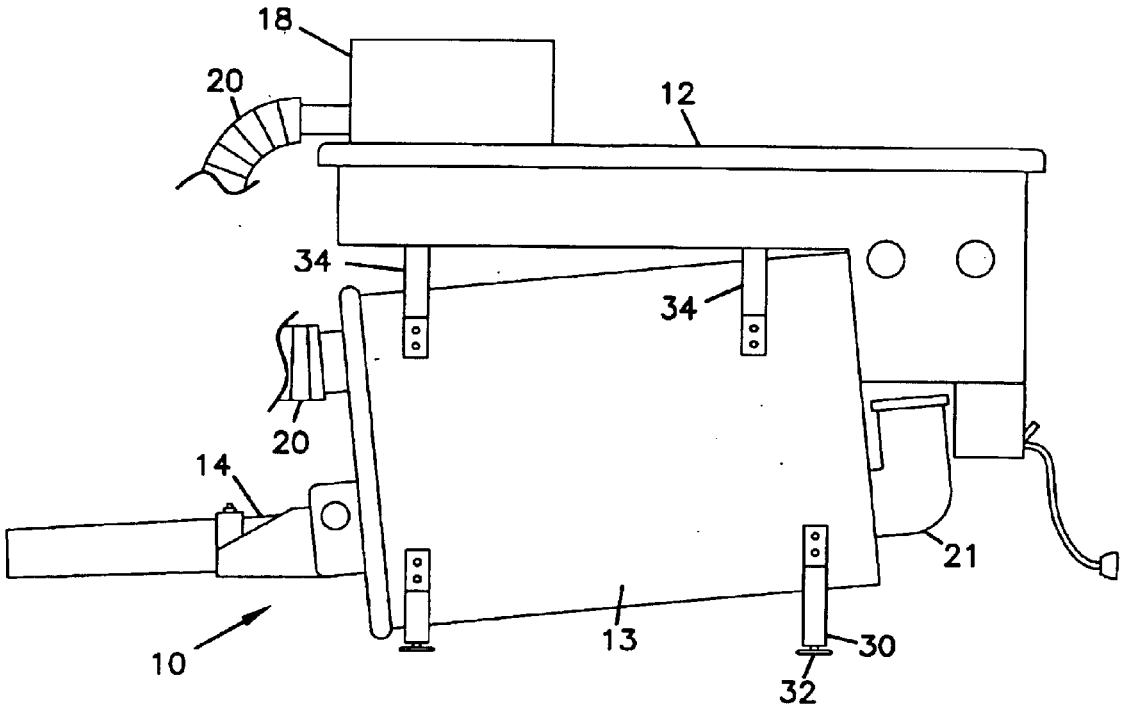
FIG. 1 is a side view of a projectile propulsion device according to an embodiment of the present invention.
Figure 2:
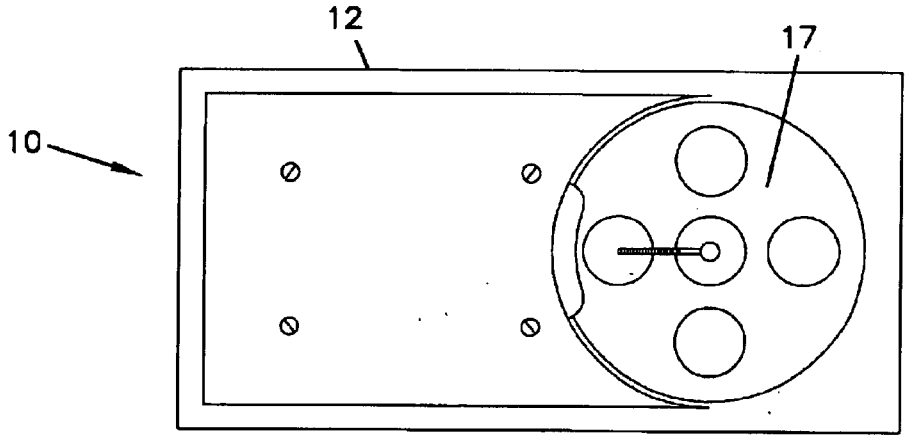
FIG. 2 is a top view of the projectile propulsion device of FIG. 1.
Figure 3:
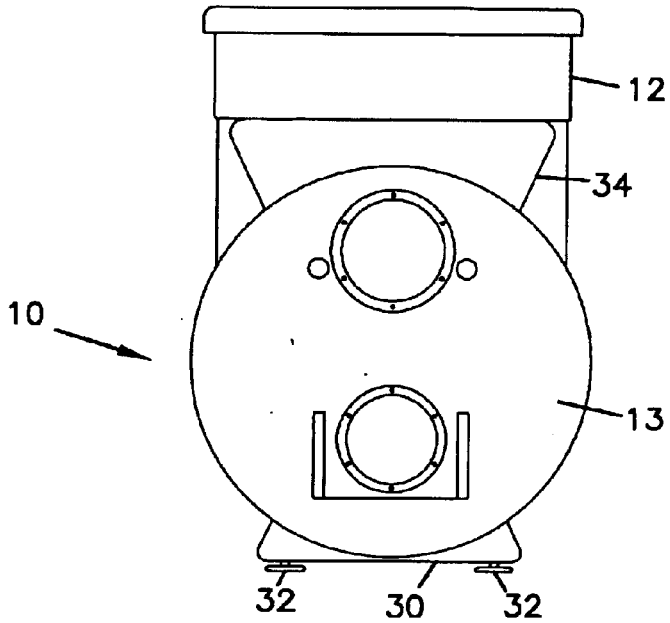
FIG. 3 is a front view of the projectile propulsion device of FIG. 1.

The pneumatic projectile propulsion apparatus according to the present invention is illustrated in FIGS. 1–5. Referring to FIG. 1, the apparatus 10 includes a hopper 12 that contains balls (or other projectiles) to be propelled, and a pressure canister 13 to which a blower is connected for supplying air to the interior of the canister. The blower can be connected to a convenient power source to supply electricity to the blower motor. The canister is provided with an exit tube 14, through which a ball or other projectile is expelled after the canister is pressurized. (Hereinafter the term "ball" will be used for brevity to encompass other projectiles as well, unless a specific limitation to a sphere is indicated in the context.) The inner diameter of the exit tube generally will be about the same as or only slightly larger than that of the ball being propelled. The angle of the exit tube can be changed to adjust the trajectory of the expelled ball.

The balls in the hopper are delivered to the interior of the canister one-by-one, for example with a rotating carousel 17 (FIG. 2) that has apertures for accepting and carrying individual balls. The balls carried by the carousel drop through an opening in the hopper to be delivered to a connector, through which the balls are fed by gravity to the interior of the canister. If desired, provision can be made for automatic delivery of projectiles from the hopper to the canister at regular intervals, for "on-demand" delivery of projectiles from the hopper to the canister, e.g. by permitting remote control operation of the carousel. The same device can be capable of either mode of delivery. In addition, delivery intervals can be controlled by blocking certain of the holes in the rotating carousel. For example, blocking every other hole will double the interval between deliveries. That is, the ball delivery intervals may be varied by changing the number of open holes in the carousel. In general, a carousel having three or four holes can be used.

The canister can have a cylindrical shape, but other shapes can be used if desired. An example of useful dimensions for the canister are a diameter of about 10–16 inches, preferably about 11 inches and a length of about 14–24 inches, preferably about 16 inches. The canister generally will have a volume of at least about 6 gallons, preferably at least about 6.5 gallons. Such volumes are useful for projecting balls and the like at speeds suitable for sports training, such as for baseball training at a collegiate level or higher. Volumes of at least 7 gallons are particularly useful for high speed propulsion. For practical reasons of portability and handling, it is desirable if the maximum volume is no more than about 8 gallons, although larger volumes might be used in some cases.

The apparatus in FIGS. 1–5 generally is oriented so that the rear of the canister (herein, front and rear are used relative to the direction of propulsion—e.g. the portion of the hopper carrying the carousel is at the rear of the canister) is higher than the front of the canister. The angle of the axis of the canister relative to horizontal typically will be not more than about 20 degrees, preferably not more than about 15 degrees. The apparatus needs to maintain the proper orientation to deliver balls from the hopper to the carousel and from the carousel down to and through the connector. At least one of the legs supporting the canister can be made adjustable to accommodate unevenness of the surface on which the canister rests. In addition, the legs of the hopper can be made adjustable in order to allow the hopper to maintain the proper orientation for delivering balls to the canister. In the illustrated embodiment, the canister has front and rear support leg structures 30, with pairs of adjustable feet 32 on each. While both the front and rear leg structures have the adjustable feature in the illustrated embodiment, it is possible to provide this for only one of them.

The hopper is supported on the canister. For simplicity, it is preferred that the hopper be oriented so that balls will travel to the exit from the hopper, e.g. the carousel 15, by gravity. In the illustrated embodiment, the hopper is supported by legs 34 so that the bed of the hopper is inclined toward the rear of the canister, thus allowing the balls to roll by gravity to the location of the carousel for delivery to the canister. These legs also could be made adjustable if desired. The hopper can be made of molded plastic or other suitable material having sufficient strength for the indicated use.

In use, balls to be propelled are delivered from the hopper to a point of entry to the interior of the canister by a connector 21, and carried to the point of exit from interior of the canister. The connector may be in the form of a tube that has a bend of about 90 degrees, and may be made of pvc or other suitable material. The connector is sealed to the canister in an airtight manner. The connector may be provided with a valve member, e.g. flap 23, that is urged toward a closed position to prevent the loss of pressure from the canister, for example by pressure built up in the canister, but can be opened by a ball delivered from the hopper or by lack of air pressure in the canister, e.g. when the canister is depressurized. It is preferred that the ball always travels in a downhill direction in the connector.

Figure 4:
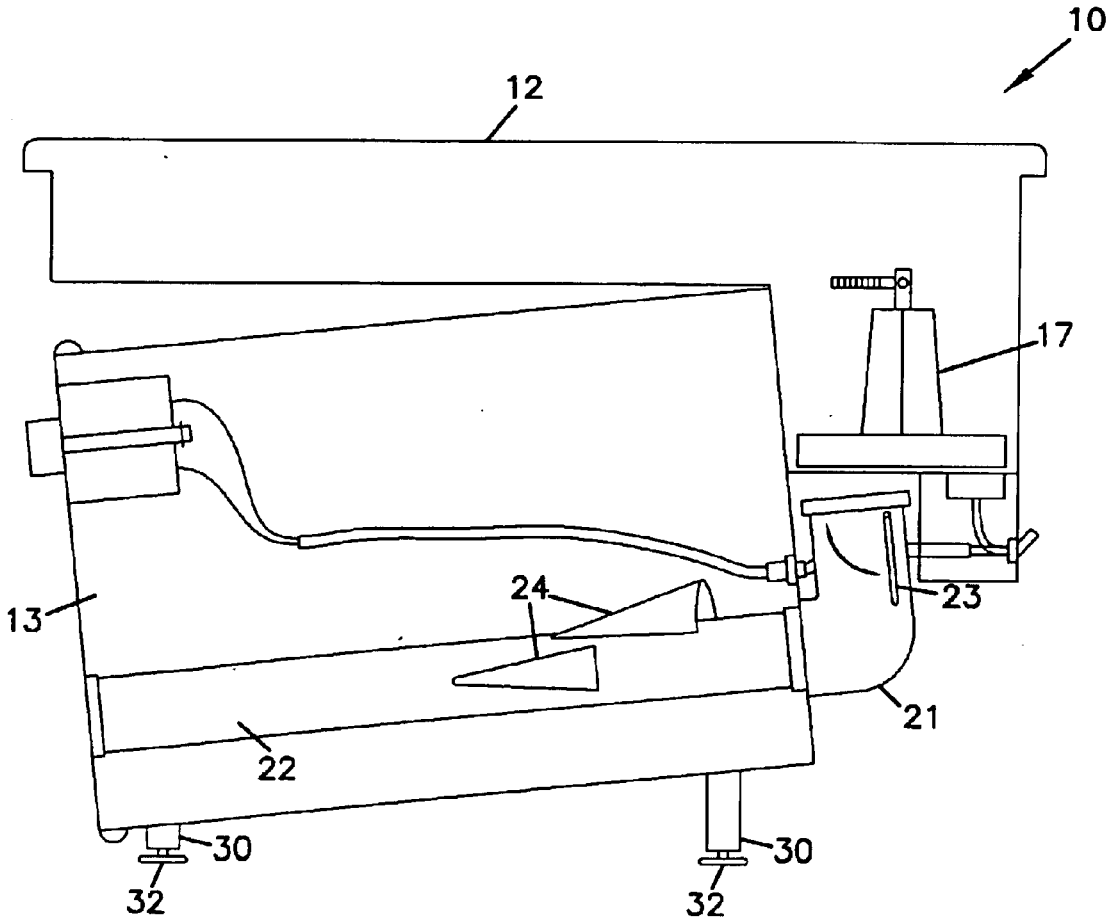
FIG. 4 is a sectional view of the projectile propulsion device of FIG. 1.
Figure 5:
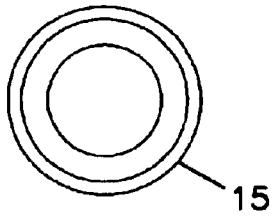
FIG. 5 is a front view of a bladder used in an exit opening of the projectile propulsion device of FIG. 1.

For simplicity, it is preferred that the balls be carried within the canister from the point of entry to the point of exit in substantially a straight line. As illustrated in FIG. 4, this can be carried out through the use of pipe 22, which extends from the point of entry into the canister to the point of exit. The pipe 22 can have a shape and size that is only slightly larger than the ball being carried. The pipe can be made, for example, of pvc or other suitable material. The straight line internal delivery provides an economical and cost effective system for varying canister size as needed for desired velocity ranges by changing the length of the canister to provide the required air volume capacity and providing a longer or shorter pipe 22 as needed.

The pipe 22 is provided with apertures, which may act as directional air intakes for the pipe, so that air supplied to the canister can move and carry balls to the canister exit. The apertures should be of sufficient size and number so that the air held under pressure in the canister can be expelled rapidly when a ball is released. In the illustrated embodiment, the apertures are provided with part-cone shaped covers 24. The shape of the covers is intended to encourage airflow in the pipe 22 toward the exit from the canister, thus assisting in the movement of the ball in the pipe and promoting the efficient release of air from the canister when the ball is propelled. In the illustrated embodiment, the size and shape of the apertures essentially match that of the covers, i.e. the apertures substantially have the shape of an elongated triangle. The apertures and covers may have different sizes and shapes. The apertures may be 2 to 5 inches in length for example, and 1 to 3 inches in width for example. The base of the triangular shape is positioned toward the rear side of the canister. The cover may have a maximum height of about 0.25 to 1.5 inches relative to the surface of the pipe 22. In one example, three apertures may be provided at different places around the circumference of the pipe. The apertures can be provided at different locations along the length of the pipe, although it is preferred that they be positioned on the half of the pipe closer to the rear of the canister. This is because when a blower is blowing air into the canister from the front of the canister, the air current will tend to be deflected off of the back wall of the canister. Positioning the apertures closer to the rear wall allows for improved passage of air into the pipe 22, especially during pressurization of the canister.

It is preferred that the pipe 22 be oriented so that a ball is always traveling in a downhill direction in the pipe. The pipe may be oriented parallel to the axis of the canister or the bottom surface of the canister.

The exit from the canister tube is provided with a resilient seal or bladder 15 that is capable of expanding radially outward, which engages the ball to be propelled. The seal may be in the shape of a ring and holds the ball in place during pressurization of the canister. The seal may be in the form of a ring-shaped rubber member held at the base of the exit tube, within the exit tube or at the end of the pipe 22, acting as a barrier to the passage of the ball.

After a ball from the hopper passes through the pipe 22 and reaches the resilient seal 15, the continued supply of air to the canister causes pressure to build behind the ball, which in turn increases the force applied to the seal by the ball. When the force between the seal and ball exceeds the resilient force of the seal (or the resilient force of the ball material), the inner surface of the seal is forced outward and/or the ball is compressed. When the inner surface of the seal is forced outward (or the ball is compressed) sufficiently to permit the ball to pass, the ball is expelled through the exit tube by the compressed air in the canister. Devices that use this general principle for the pneumatic propulsion of tennis balls are known, for example devices marketed by "LobSter", and therefore more detailed description of their operation is omitted.

The air pressure and volume accumulated behind the ball when it is expelled from the exit tube determine the speed at which the ball is propelled. This can be varied by changing the characteristics of the seal, e.g. dimensions and/or materials. For example, a seal having a smaller aperture will allow an increased pressure build up and thus allow the ball to be propelled at a higher speed. In addition, different capacity blowers, multiple blowers and/or larger canisters can be used as necessary to provide sufficient air pressure and volume for the desired speed.

The exit systems for pneumatic ball propulsion systems typically have exit tubes that are no more than about 21 inches (53 cm) in length. For the present purposes, this length is determined as the distance from the point at which the ball is released (the resilient seal location in the above embodiment) to the exit end of the tube. While this may provide sufficient accuracy for purposes such as tennis, it may not provide sufficient accuracy at higher speeds for purposes such as baseball and softball training, where location accuracy on the order of a few inches (cm) or less at a distance of 40 feet (13 m) or more (about 54 feet (17 m) in the case of simulating a release point for baseball training) is desired.

In order to provide improved accuracy and speed, an apparatus of the present invention may use an extension of the exit tube. The extension tube preferably is secured to the exit tube 14 with a seal, for example a lock pin seal, to provide a substantially airtight connection. Clamps, tapped connections, threaded connections, tape and other devices can be used as appropriate. Alternatively, the exit tube 14 can be formed of a sufficient length to provide the desired accuracy and velocity. The length necessary for achieving a particular accuracy will change depending on the speed of the balls. For purposes of ball speeds in a range of about 40–65 mph (about 65–105 kph), the exit tube length should be at least about 15 inches (about 35 cm), preferably at least 20 inches (about 50 cm). For higher ball speeds, longer exit tube lengths are necessary. For example, for ball speeds as high as 75 mph or 90 mph (120 kph or 145 kph) or more, an exit tube length of 3 to 4 feet (1 to 1.3 m) or more may be needed. For example an extension tube may have a length of about 4.5 feet (1.5 in). Generally, the exit tube should be the shortest length that provides the desired accuracy and speed, as an excessive tube length can cause ball speed to drop and makes the apparatus less portable. The exit tube length can be varied with respect to speed and accuracy for the intended application.

In a preferred embodiment, the exit tube will have a length from 2.5 feet (0.8 m) to 5.5 feet (1.7 m), particularly 3 feet (1 m) to 5.5 feet (1.7 m), more particularly 3 feet (1 m) to 5 feet (1.5 m), and more particularly 4 feet (1.3 m) to 5 feet (1.5 m). This is especially useful for baseball training.

It also may be desirable to use an exit tube whose exit end has a color that provides an enhanced visual focal point for someone using the apparatus for training. For example, the exit end, and particularly the end face of the tube facing the user, could be painted (or otherwise colored) in a fluorescent red color. Other colors might be used if desired.

For high level training, especially in sports such as baseball or tennis, and which can include vision training, it is desirable to project a ball at speeds of about 100 mph (160 kph) and higher. While it is possible to achieve speeds of about 140 mph (220 kph) and higher with a reasonably practical canister size by using multiple blower motors, this suffers from practical drawbacks in terms of requiring special electric circuitry or dual wires to separate power sources on different circuits, and renders such apparatus useful only in relatively specialized applications. Therefore, in one aspect of the present invention, the ball projecting apparatus is capable of projecting a ball at a speed of at least 110 mph (175 kph), for example in a range from about 50 mph to 115 mph (80 to 185 kph) and makes use of a single blower requiring no more than 15 amps of current. An example of a suitable blower is the Ametek Model 117500-12 blower available from Lamb Electric of Kent Ohio, which is a 7.2 inch (183 mm) fan diameter three-stage tangential bypass discharge blower that can operate on a typical "house" voltage of 120 volts, drawing no more than 15 amps of current. Such a blower has a maximum airflow of about 102.5 cfm for general motor performance and is capable of supplying a canister discussed above with a pressure of about 4–7 psi, preferably about 5–7 psi, more preferably about 5–6 psi, which is sufficient to propel a tennis ball-sized projectile at a speed of over 100 mph (160 kph) at the volumes noted above. The use of a single motor blower drawing less than 15 amps of current is particularly useful for baseball and softball training.

It is possible to allow for changing the ball speed for a given tube length by providing selectively openable apertures on the exit tube. Opening an aperture on the exit tube results in the loss of some of the air compression, thereby decreasing the ball speed. When a plurality of such apertures is provided, the options for varying ball speed increase. Opening more apertures, or increasing the effective size of an aperture, reduces the ball speed more. For example, this allows for simulation of change-ups and other off-speed pitches for baseball or softball training. The selectively openable apertures could be in the form of one or more simple holes that can be covered selectively by an operator, for example five or six holes 0.25 or 0.5 inches in diameter spaced about 0.75 inch apart. In one embodiment, one or more of the holes can be covered by a sleeve that slides along the outside of the exit tube. It also is possible to cover one or more of the openings with finger(s). The two can be used in combination. For example, the use of fingers may help disguise the possible speed reduction if a particular batter is able to anticipate a speed reduction based on the position of the sleeve. Typically, the speed reduction will be in the range of 5 to 20 mph.

In the ball propulsion apparatus shown in FIGS. 1–5, the hopper carries a cover 18, which houses a blower. The cover can be provided with ventilation holes for the blower if necessary. In one example, the blower can be secured to the hopper, e.g. with bolts or the like that extend through the hopper sidewall and/or bottom. In addition or instead, one or mounting brackets can be secured to the hopper, with the blower secured to the mounting bracket(s). The cover also can be secured to the hopper by screws or the like that extend through the sidewall and/or bottom. The blower expels air through an outlet to tubing 20, which delivers the air to the canister 15. The tubing can be made of any suitable material, e.g. flexible tubing as is commonly used in pulling a vacuum or other tubing such as pvc tubing, depending on the specific application. Tubing connections can be secured, for example, with automotive hose clamps or the like as needed. Also, instead of the cover and blower being carried in the hopper, the cover for a blower can act as a support for the canister and hopper. The cover may be of a parallelepiped configuration, although to provide improved stability it might be useful if the bottom of the cover is larger (i.e. covers a larger area) than the top. The bottom of the cover can be larger in the front-to-back and/or side-to-side direction. The canister may be secured to the cover in any suitable manner. In this case, the blower expels air through an opening in the top of the cover, and communicates with the canister by a short pipe, allowing a simple and direct air supply to the canister and improving the balance of the machine.

In the illustrated embodiment, connection to a power source to drive the carousel and the blower can be made at the rear of the apparatus. Suitable controls, such as on/off switches, are provided as desired. In the illustrated embodiment, when the blower is carried in the front of the hopper the wiring for delivering power to the blower can pass through the interior of the canister, through the front wall of the canister and thence to the blower, passing through the cover as needed.

In the ball propulsion apparatus shown in FIGS. 1–5, the blower is outside of the canister. This is advantageous in that it increases the effective volume of the canister. However, providing the blower inside of the canister is possible.

Figure 7:
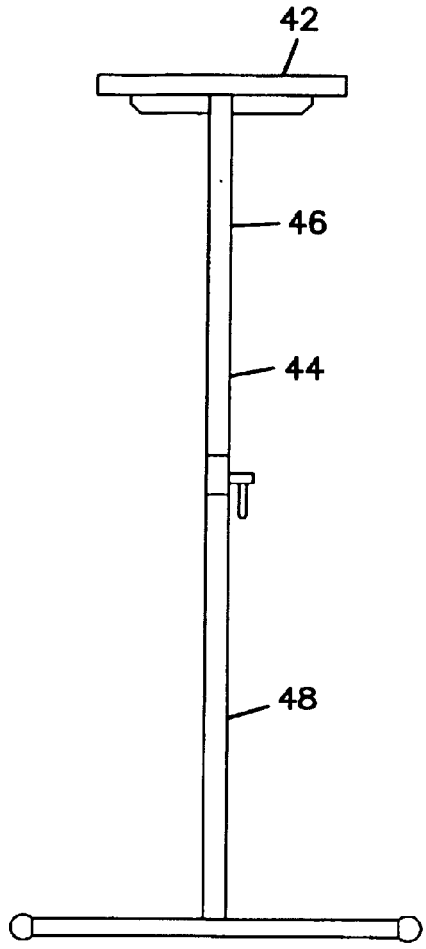
FIG. 7 is a side view of the support device of FIG. 6.
Figure 6:
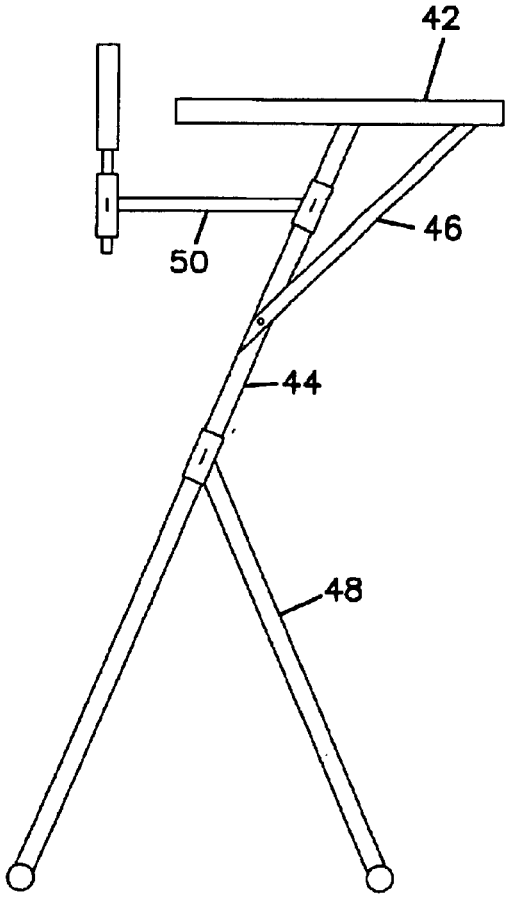
FIG. 6 is a side view of a support device that can be used to support a projectile propulsion device.

Referring to FIGS. 6–7, a stand is illustrated, for example useful for a pneumatic projectile propulsion apparatus discussed above. The stand includes a platform 42, a main leg 44 that is secured to the platform and engages the ground (or other surface on which the stand rests), a first strut 46 that extends from the main leg to the platform, and a second strut 48 that extends from the main leg to the ground. The first and second struts are positioned on the same side of the main leg. The second strut can be mounted to the main leg in a lockable pivoting manner so that the size of the stand can he reduced for transportation. The main leg can have an adjustable length, allowing a projecting apparatus to be positioned at different heights for different purposes. In addition, when the height is easily adjusted, e.g. through a crank or similar mechanism, the platform can be raised and lowered as desired. For example, if the intended purpose is training for return of serve in tennis, it may be desirable for the platform to be 7–8 feet high or more. Lowering the platform allows the supply of balls in the hopper to be replenished easily.

The stand also can be provided with a further support 50. This support can fold relative to the main leg 44, and can carry a tube support 52 for the exit tube of a propulsion apparatus. The tube support 52 can include adjustment provisions, e.g. for lateral and/or vertical adjustment, as disclosed in Ser. No. 10/091,126. This provides close control over the direction in which the ball is propelled. The stand can be made of metal tube or other suitable material. Pins or other suitable structures can be used for maintaining the foldable members in the desired position for use of the stand.

The various aspects of the pneumatic ball propulsion apparatus are useful in training methods for sports making use of a ball, such as baseball, softball, tennis and cricket, particularly for baseball and softball. In these training methods, the ball or other projectile will be projected in the general direction of a person wielding an implement such as a bat or racket that is intended to make contact with the projectile. In addition, they may be useful for training in other activities, e.g. for training for goalkeepers in sports such as hockey and lacrosse. While the illustrated embodiment is useful for propelling tennis balls, the invention can be adapted to other balls, such as baseballs, softballs, pickle balls and wiffle balls, and to non-ball projectiles as well.

While a detailed description of the present invention has been provided above, the invention is not limited thereto, and modifications thereto will be apparent. The invention is defined by the following claims.

What is claimed is:

1. A pneumatic projectile propulsion apparatus, comprising:

a pressure canister for containing a supply of air for pneumatically propelling a projectile, comprising an exit aperture through which a projectile is expelled;

a hopper for containing projectiles to be supplied to the canister;

a connector for delivering projectiles from the hopper to the canister by gravity; and a blower for supplying air to the canister, wherein a projectile travels in a substantially straight line from a point of entry into the canister to the exit aperture.

2. A pneumatic projectile propulsion apparatus according to claim 1, wherein a forward end of the canister is lower than a rear end of the canister.

3. A pneumatic projectile propulsion apparatus according to claim 2, wherein the line of travel for a projectile in the canister is substantially parallel to a bottom surface of the canister.

4. A pneumatic projectile propulsion apparatus according to claim 2, further comprising an adjustable support leg.

5. A pneumatic projectile propulsion apparatus according to claim 4, wherein the adjustable support leg is at a front position of the canister.

6. A pneumatic projectile propulsion apparatus according to claim 4, wherein the adjustable support leg is at a rear position of the canister.

7. A pneumatic projectile propulsion apparatus according to claim 1, wherein the blower is a single electric motor blower that draws less than 15 amps of current and the apparatus is capable of propelling a tennis ball-sized or baseball-sized projectile at a speed of at least 90 mph.

8. A pneumatic projectile propulsion apparatus according to claim 7, wherein the apparatus is capable of propelling a tennis ball-sized or baseball-sized projectile at a speed of at least 110 mph.

9. A pneumatic projectile propulsion apparatus according to claim 1, wherein the canister has a capacity of at least 6 gallons.

10. A pneumatic projectile propulsion apparatus according to claim 9, wherein the capacity is 6.5 to 8 gallons.

11. A pneumatic projectile propulsion apparatus according to claim 1, further comprising a substantially straight tube that defines a path of the projectile in the canister.

12. A pneumatic projectile propulsion apparatus according to claim 11, wherein a sidewall of the tube has an aperture.

13. A pneumatic projectile propulsion apparatus according to claim 12, wherein the aperture is elongated in a direction of the length of the tube.

14. A pneumatic projectile propulsion apparatus according to claim 13, further comprising a partially cone shaped cover for the aperture.

15. A pneumatic projectile propulsion apparatus according to claim 14, wherein the aperture has a shape of an elongated triangle, with a base of the triangle being positioned toward the point of entry of the canister.

16. A pneumatic projectile propulsion apparatus according to claim 1, wherein the connector has a bend of about 90 degrees.

17. A pneumatic projectile propulsion apparatus according to claim 16, further comprising a movable flap at an end of the connector adjacent the hopper.

18. A pneumatic projectile propulsion apparatus according to claim 1, which is capable of propelling a tennis ball-sized or baseball-sized projectile at a speed of at least 140 mph.

19. A pneumatic projectile propulsion apparatus according to claim 18, wherein a plurality of blowers are used.

20. A pneumatic projectile propulsion apparatus according to claim 19, wherein the canister has a capacity of at least 7 gallons.

* * * * *